US010206518B2

(12) United States Patent
Burns et al.

(10) Patent No.: US 10,206,518 B2
(45) Date of Patent: Feb. 19, 2019

(54) COMPACT JUMPER

(71) Applicant: KIDS II, INC., Atlanta, GA (US)

(72) Inventors: Stephen R. Burns, Cumming, GA (US); Alex Soriano, Sandy Springs, GA (US); Blake D. Pomeroy, New Market, MD (US); Cary Costello, Atlanta, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 15/484,920

(22) Filed: Apr. 11, 2017

(65) Prior Publication Data

US 2017/0245658 A1 Aug. 31, 2017

Related U.S. Application Data

(63) Continuation of application No. 14/941,997, filed on Nov. 16, 2015, now Pat. No. 9,615,673, which is a continuation-in-part of application No. 14/173,066, filed on Feb. 5, 2014, now Pat. No. 9,185,994.

(60) Provisional application No. 61/864,156, filed on Aug. 9, 2013, provisional application No. 61/761,277, filed on Feb. 6, 2013.

(51) Int. Cl.

| | |
|---|---|
| ***A47D 13/04*** | (2006.01) |
| ***A47D 13/10*** | (2006.01) |
| ***A47D 1/00*** | (2006.01) |
| ***A47D 15/00*** | (2006.01) |

(52) U.S. Cl.

CPC ..... *A47D 13/107* (2013.01); *A47D 1/008* (2013.01); *A47D 15/00* (2013.01)

(58) Field of Classification Search

CPC ..... A47D 3/00; A47D 13/107; A47D 11/00; A47D 1/008; A47D 15/00; Y10S 297/11

USPC ..... 297/5, 274

See application file for complete search history.

(56) References Cited

U.S. PATENT DOCUMENTS

| | | | |
|---|---|---|---|
| 16,150 | A | 12/1856 | Robbins |
| 616,697 | A | 12/1898 | Cowles et al. |
| 1,057,360 | A | 3/1913 | Patten |
| 1,104,609 | A | 7/1914 | Blain |
| 1,204,249 | A | 11/1916 | Condon, Jr. |
| 1,326,921 | A | 1/1920 | Dzimitowicz |
| 1,428,039 | A | 9/1922 | Kratz |
| 1,518,671 | A | 12/1924 | Novinsky |
| 1,832,755 | A | 11/1931 | Waddell |
| 1,950,042 | A | 3/1934 | Upper |
| 2,704,111 | A | 3/1955 | Wunderlich |
| 3,494,613 | A | 2/1970 | Hatfield |
| 3,730,587 | A | 5/1973 | Bloxham et al. |

(Continued)

FOREIGN PATENT DOCUMENTS

| | | | |
|---|---|---|---|
| GB | 2513469 | A | 10/2014 |
| JP | 2013165963 | A | 8/2013 |

*Primary Examiner* — Rodney B White
(74) *Attorney, Agent, or Firm* — Gardner Groff Greenwald & Villanueva, PC

(57) ABSTRACT

A compact jumper for an infant or young child. The compact jumper includes a support frame, at least one resilient member, and a child-receiving apparatus. The support frame is configured for resting on a support surface and the at least one resilient member is coupled to a portion of the support frame. The child-receiving apparatus is supported by the at least one resilient member, with a collar mounting the resilient member to the child-receiving apparatus, and is guided by a portion of the support frame. The child-receiving apparatus is movable with respect to the support surface as the child moves and jumps.

19 Claims, 9 Drawing Sheets

(56) References Cited

U.S. PATENT DOCUMENTS

| | | | |
|---|---|---|---|
| 3,759,539 | A | 9/1973 | Goldberg |
| 4,160,553 | A | 7/1979 | Fleischer |
| 4,948,120 | A | 8/1990 | Krueger et al. |
| 5,201,693 | A | 4/1993 | Sparkes |
| 5,288,283 | A | 2/1994 | Meeker |
| 5,407,246 | A | 4/1995 | Meeker et al. |
| 5,433,682 | A | 7/1995 | Fermaglich et al. |
| 5,458,550 | A | 10/1995 | Braim et al. |
| 5,499,949 | A | 3/1996 | Heubl |
| 5,688,211 | A | 11/1997 | Myers |
| 5,690,383 | A | 11/1997 | Meeker |
| 5,700,201 | A | 12/1997 | Bellows et al. |
| 5,704,882 | A | 1/1998 | Coates et al. |
| 5,816,983 | A | 10/1998 | Dawes et al. |
| 5,857,944 | A | 1/1999 | Cone et al. |
| 5,863,097 | A | 1/1999 | Harper et al. |
| 5,876,311 | A | 3/1999 | Coates et al. |
| 5,887,945 | A | 3/1999 | Sedlack |
| 5,934,747 | A | 8/1999 | Garland |
| 5,947,875 | A | 9/1999 | Cone et al. |
| 6,000,750 | A | 12/1999 | Rossman et al. |
| 6,179,376 | B1 | 1/2001 | Meeker et al. |
| 6,229,247 | B1 | 10/2001 | Meeker et al. |
| 6,592,425 | B2 | 7/2003 | Bapst et al. |
| 6,817,864 | B1 | 11/2004 | Martinez |
| 6,854,799 | B1 | 2/2005 | Asbach et al. |
| 6,932,706 | B1 | 8/2005 | Kaminkow |
| 6,932,709 | B1 | 8/2005 | Gubitosi et al. |
| 6,994,630 | B2 | 2/2006 | Paesang |
| 7,017,924 | B1 | 3/2006 | Lambert |
| 7,044,892 | B2 | 5/2006 | Stern et al. |
| 7,438,644 | B2 | 10/2008 | Gubitosi et al. |
| 7,472,964 | B2 | 1/2009 | King |
| 7,523,984 | B2 | 4/2009 | Steininger |
| 7,614,930 | B2 | 11/2009 | Berkey et al. |
| 7,614,979 | B2 | 11/2009 | Thomson et al. |
| 7,727,076 | B2 | 6/2010 | Bapst et al. |
| 7,878,915 | B2 | 2/2011 | Myers et al. |
| 7,963,896 | B2 | 6/2011 | Nanna et al. |
| D650,207 | S | 12/2011 | Soriano et al. |
| D650,208 | S | 12/2011 | Soriano et al. |
| 8,070,617 | B2 | 12/2011 | Barron et al. |
| 8,182,355 | B2 | 5/2012 | Bapst et al. |
| 8,267,803 | B2 | 9/2012 | Trapp et al. |
| 8,303,033 | B2 | 11/2012 | Lundeen |
| 8,308,239 | B2 | 11/2012 | Lundeen |
| 8,357,054 | B2 | 1/2013 | Myers et al. |
| D675,454 | S | 2/2013 | Soriano et al. |
| D685,197 | S | 7/2013 | Soriano et al. |
| D690,947 | S | 10/2013 | Gillett |
| 8,556,349 | B2 | 10/2013 | Welch et al. |
| 8,591,347 | B2 | 11/2013 | Sonner et al. |
| 8,708,875 | B2 | 4/2014 | Prohaska et al. |
| 8,845,441 | B2 | 9/2014 | Trapp et al. |
| 8,968,110 | B2 | 3/2015 | Bapst et al. |
| 8,979,662 | B2 | 3/2015 | Rogers et al. |
| 9,010,711 | B2 | 4/2015 | Pleiman et al. |
| 9,185,994 | B2 | 11/2015 | Burns et al. |
| 9,198,547 | B2 | 12/2015 | Ondaatje et al. |
| 9,204,733 | B2 | 12/2015 | Welch et al. |
| 9,615,673 | B2 | 4/2017 | Burns et al. |
| 2002/0164917 | A1 | 11/2002 | Keegan et al. |
| 2008/0012409 | A1 | 1/2008 | Chen et al. |
| 2008/0113581 | A1 | 5/2008 | Jazenski et al. |
| 2008/0194389 | A1 | 8/2008 | Southerland |
| 2010/0159428 | A1 | 6/2010 | Grasing et al. |
| 2011/0012408 | A1 | 1/2011 | Lee et al. |
| 2013/0093227 | A1 | 4/2013 | Mendes et al. |
| 2014/0366276 | A1 | 12/2014 | Chang et al. |
| 2015/0282641 | A1 | 10/2015 | Crane et al. |
| 2015/0289676 | A1 | 10/2015 | Huntsberger et al. |
| 2015/0289677 | A1 | 10/2015 | Huntsberger et al. |

COMPACT JUMPER

CROSS-REFERENCE TO RELATED APPLICATIONS

This application is a continuation of U.S. Non-Provisional patent application Ser. No. 14/941,997 filed Nov. 16, 2015, now U.S. Pat. No. 9,615,673, which is a continuation-in-part of U.S. Non-Provisional patent application Ser. No. 14/173,066 filed Feb. 5, 2014, which issued as U.S. Pat. No. 9,185,994 on Nov. 17, 2015, which claims the priority benefit of U.S. Provisional Application Ser. No. 61/761,277 filed Feb. 6, 2013 and U.S. Provisional Patent Application Ser. No. 61/864,156 filed Aug. 9, 2013, the entireties of which are hereby incorporated by reference herein.

TECHNICAL FIELD

The present invention relates generally to the field of children's activity toys, seats and accessories, and more particularly to children's jumpers and free-standing jumpers.

BACKGROUND

Swings, jumpers, bouncers and other similar devices are typically utilized to entertain and stimulate an infant or child in a safe location, which additionally provides an environment that promotes the development of a child's gross motor skills. Known jumpers, however, can be inconvenient to use, large and bulky in size, difficult to store, and not readily adjustable to accommodate children of different sizes.

Accordingly, it can be seen that needs exist for an improved jumper. It is to the provision of an improved jumper meeting these and other needs that the present invention is primarily directed.

SUMMARY

According to example embodiments, the present invention relates to an infant jumper seat including a support frame, at least one resilient member and a child-receiving apparatus. The support frame is configured for resting on a support surface or underlying floor and the at least one resilient member is coupled to the frame. The child-receiving apparatus is supported by the at least one resilient member and guided by a portion of the support frame such that the child-receiving apparatus is movable with respect to the support surface in a vertical direction.

In one aspect, the invention relates to an infant jumper including a seat assembly comprising a seat platform with a seat mounted thereto, the seat platform preferably defining at least one frame opening. The jumper further includes a support frame having at least one upright support post extending through the frame opening of the seat platform. At least one resilient member extends between the support post and the seat platform to suspend the seat assembly from the support frame and allow movement of the seat relative to the support frame. In an example form, the movement is substantially vertical.

In another aspect, the invention relates to a compact jumper including a support frame having a base and at least one support post. The jumper preferably also includes a seat assembly having a seat platform with a seat mounted thereto, the seat platform defining at least one frame opening through which a corresponding support post extends. At least one resilient member preferably extends between each support post and the seat assembly, whereby motion of the seat assembly is constrained vertically by the at least one resilient member and is constrained laterally by the at least one support post extending through the corresponding frame opening of the seat platform.

In still another aspect, the invention relates to a compact infant jumper comprising a support frame and a seat assembly movably mounted to the support frame, wherein a spatial envelope having a volume of no more than about 11.09 cubic feet circumscribes and contains the compact infant jumper.

In an example embodiment, the support frame includes a base and three upright frame members. The base is optionally formed of three base frame members coupled together with connectors, and the upright frame members optionally couple to the connectors and extend in a direction generally transverse to the plane of the base. The child-receiving apparatus generally includes a seat platform and a seat or saddle generally centrally-positioned thereon. The seat is optionally rotatable about 360° degrees or some portion thereof, and the seat platform includes openings through which the upright frame members extend. A first portion of the resilient member couples to the seat platform and a second portion of the resilient member couples to the at least one upright frame member.

Optionally, an adjustment knob can be rotationally coupled between the upright frame member and the resilient member to provide adjustment of the height of the seat platform relative to the support surface. In one form, the resilient member is a coil spring having a conical shape, wider at its point of connection to the seat platform and thinner at its point of connection to the upright frame member. Optionally, the coil spring may include a flexible cover to prevent pinching. Optionally, the seat platform includes one or more recessed portions configured to receive one or more removable toy panels. Further optionally, the seat platform includes one or more female receiving members and the removable toy panels include one or more corresponding male insertion members configured to removably engage the seat platform.

In another aspect, the invention relates to a compact jumper including a support frame, a plurality of resilient members, and a child-receiving apparatus. The support frame is configured for resting on a support surface and includes a plurality of base frame members and a plurality of upright frame members. The base frame members couple together with connectors and the upright frame members couple to the connectors and extend in a direction generally transverse the base frame members. In one example form, the plurality of resilient members couple to the upright frame members. The child-receiving apparatus includes a seat platform and a seat and is supported by the plurality of resilient members and guided by the plurality of upright frame members.

In example embodiments, the compact jumper is configured to be bounded by a volumetric or geometric size envelope comprising a length, a width and a height, or alternatively comprising a diameter and a height. The volume of the volumetric envelope is generally equal to or less than 11.08 cubic feet, where for example, the length is about 2.45 feet, the width is about 2.55 feet, and the height is about 1.77 feet. Alternatively the diameter is about 5.3 feet and the height is about 1.77 feet.

In other example embodiments, the seat platform includes a plurality of openings for receiving the upright frame members for allowing the child-receiving apparatus to be suspended and guided thereon. In one form, the plurality of resilient members are in the form of coil springs having a first end and a second end. The coil springs are configured to be fitted around the plurality of upright frame members whereby the first ends of the coil springs are coupled to the seat platform proximal the openings and the second ends of the coil springs are coupled to an upper portion of the plurality of upright frame members. Optionally, the coil springs have a conical shape.

In still other example embodiments, an adjustment knob can be rotationally coupled to the upper portion of each of the plurality of upright frame members, wherein the second ends of the coil springs are coupled to the adjustment knob to provide for adjusting the height of the seat platform relative to the adjustment knob.

In yet other example embodiments, a collar mounts the spring (or other resilient member) to the seat platform of the child-receiving apparatus, wherein the collar typically positions the bottom end of the spring above the top surface of the seat platform.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
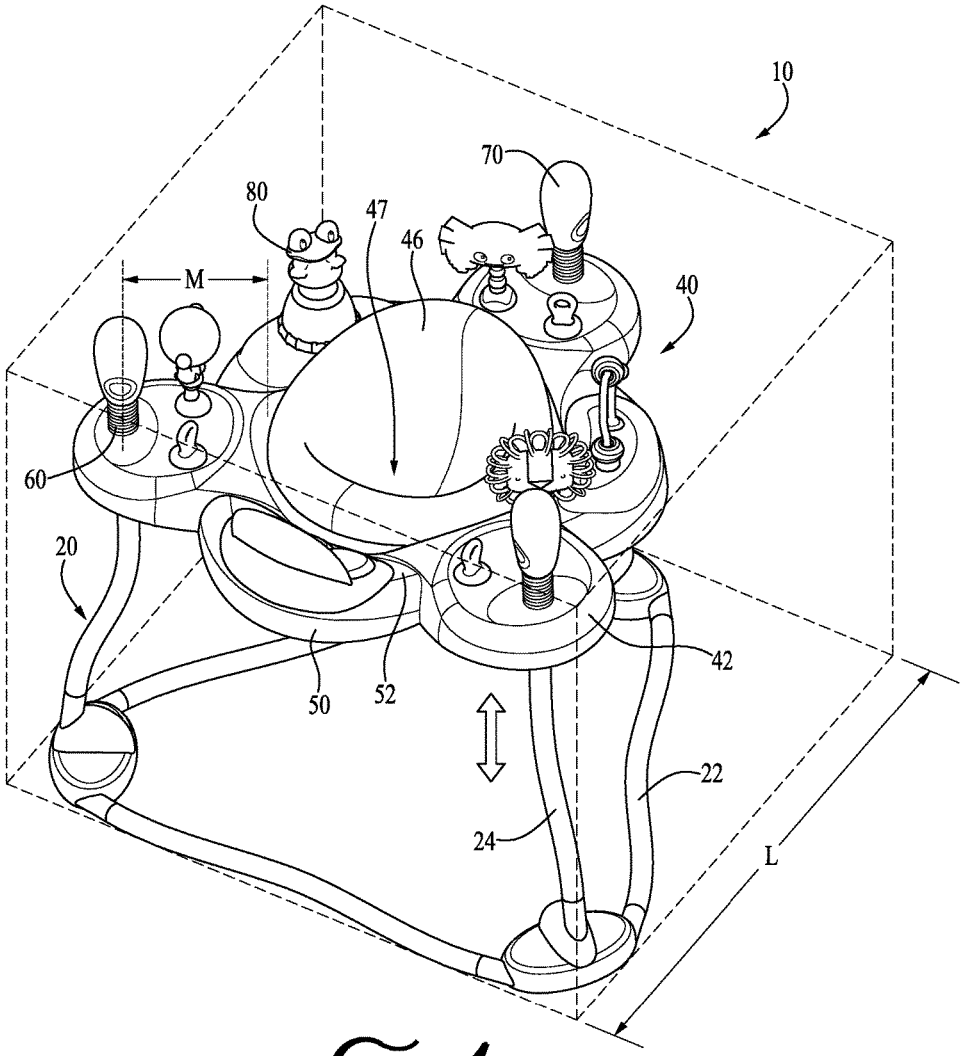
FIG. 1 is a perspective view of a compact jumper according to an example embodiment of the present invention.
Figure 2:
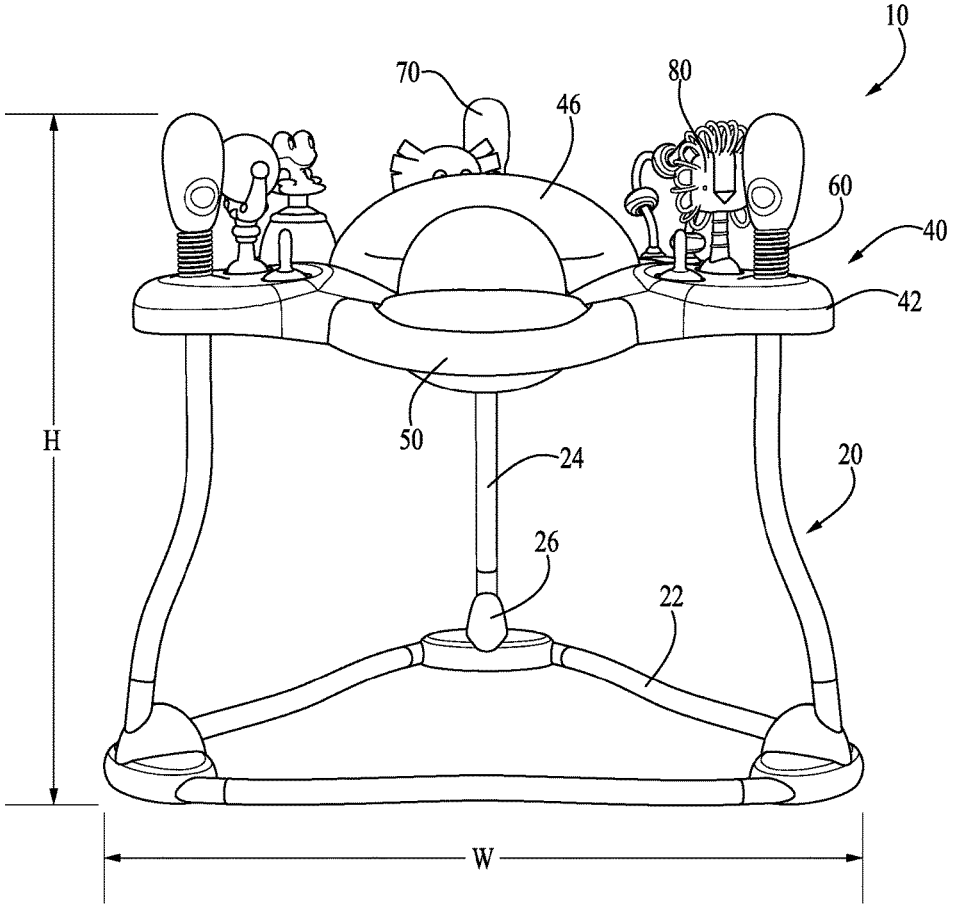
FIG. 2 is a side view of the compact jumper of FIG. 1.

With reference now to the drawing figures, wherein like reference numbers represent corresponding parts throughout the several views, FIGS. 1-2 show a compact jumper 10 according to one example embodiment of the present invention. As shown, the jumper 10 comprises a base or support frame 20, a child-receiving apparatus or seat panel 40 and at least one resilient support or suspension member 60. In example embodiments, the frame 20 is configured to rest on a support surface (e.g., floor or other underlying ground surface) and the child-receiving apparatus 40 is supported by the frame 20. Preferably, the at least one resilient member 60 comprises a first end coupled to the frame 20 and a second end coupled to the child-receiving apparatus 40 such that the child-receiving apparatus 40 is suspended from the frame 20, and the resilient member permits the child-receiving apparatus to bounce up and down with respect to the support surface 12, for example when an infant or child is occupying the child-receiving apparatus 40 and is moving about and jumping to entertain themselves and help develop their motor skills and strength. In one example embodiment, at least one portion of the frame 20 serves as a guide or alignment member for the at least one resilient member 60 and the child-receiving apparatus 40 to guide the child-receiving apparatus 40 along a motion path that is substantially or at least partially vertical, whereby the child's activity allows them to move in opposition to gravity. Thus, the child-receiving apparatus 40 is generally movably mounted to the frame 20 and is capable of moving in a substantially or at least partially vertical motion path. Generally, the travel distance of the child-receiving apparatus 40 along the substantially vertical motion path is determined by the resiliency of the at least one resilient member 60, and is within a desired range of motion of the child's activity.

In one example form, the base or frame 20 is substantially compact in size and comprises a plurality of lower base frame members 22 and a plurality of upright frame members or posts 24. For example, as depicted in FIGS. 1-2, the frame 20 comprises three base frame members 22 and three upright frame members 24. In example embodiments, the ends of each base frame member 22 are coupled to T-shaped or three-way connectors 26 to form a generally triangular-shaped base frame. The T-shaped connectors 26 generally comprise three socket couplings or fittings for coupling the base and upright frame members 22, 24 together, for example, two of the fittings configured for receiving ends of the base frame members 22 and one fitting configured for receiving an end of the upright frame members 24. Generally, a triangular-shaped base is formed when the base frame members 22 are coupled together by the connectors 26, and the upright frame members 24 generally extend in a direction generally transverse the base frame members 22. In alternate embodiments, four or more base frame members may comprise a rectangular, square, polygonal, round or otherwise configured base, or a unitary base panel can be provided. In example forms, the base and upper frame members 22, 24 are coupled to the connectors 26 by providing a frictional fit therebetween, and or by one or more couplings, connectors or attachment means. In example embodiments, the frame members are substantially rigid rods, bars, tubes, beams or other structural members formed of aluminum, steel, plastic, composite or other structural material(s), and are optionally connected together by hinges, pin joints, coupling members, snaps, clips, pins, adhesives, or other connection or coupling means.

The child-receiving apparatus 40 generally comprises a seat platform 42 and a seat or saddle 46. In one example form, the seat 46 is generally centrally-positioned on the seat platform 42 and is comprised of a seat ring (not shown) rotatably coupled to the seat platform 42 and a child-receiving sling 47 supported by the seat ring. The sling 47 includes a pair of leg holes for a child's legs to pass through and extend towards the support surface. A child positioned in the sling 47 can move by jumping up and down with support of the seat, and/or by rotating the seat 46 with respect to the seat platform 42 by pushing off the support surface. The seat 46 can be rotationally mounted within the opening to provide for 360° degrees of rotation, thus allowing the infant to access and interact with any portion of the seat platform 42. As will be described below, the seat platform 42 can comprise one or more removable toy panels 50 to entertain and stimulate a child that is positioned in the sling 47.

As depicted, the seat platform 42 has an outer peripheral contour generally conforming to the contour of the assembled base frame members 22, for example generally triangular-shaped. Alternatively the seat platform 42 can be otherwise shaped, for example, rectangular, circular, polygonal, irregular or otherwise. Preferably, the seat platform 42 comprises at least one opening for receiving the upright frame member or post 24 therethrough. In the depicted embodiment, the seat platform 42 comprises three openings generally positioned near or spaced inwardly from its outer periphery in a triangular array for permitting the three upright frame members 24 of the base structure to extend therethrough. Optionally, the seat platform 42 can comprise more or fewer openings for receiving a corresponding number of upright frame members. Thus, for example, in another example embodiment, the frame 20 comprises four upright frame members and the seat platform 42 comprises at least four openings in a square or rectangular array to permit extension of the upright frame members therethrough.

The seat platform 42 may also include one or more removable toy panels 50. Preferably, each of the toy panels 50 includes one or more entertaining toy or child interaction devices 80 coupled to an upper surface 52 of the toy panel 50. Thus, when the toy panels 50 are coupled to the seat platform 42, a child positioned in the seat 46 will be able to view and engage the toy devices. The toy panels 50 can also be removed from the seat platform 42 and used independently from the jumper 10. For example, the toy panels 50 can be placed on a floor or kitchen table for use by an older child who has outgrown the seat 46, and/or different toy panels can be interchanged in and out of the seat platform.

Figure 3:
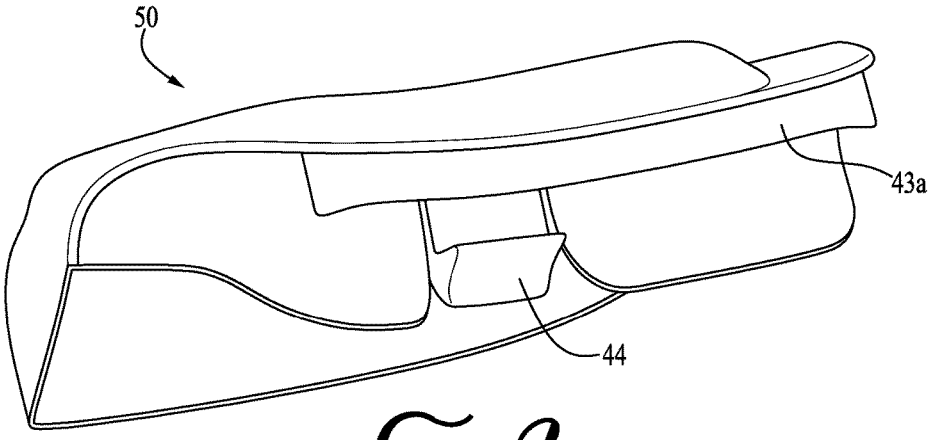
FIG. 3 is a bottom perspective view of a toy panel of the compact jumper of FIG. 1.
Figure 4:
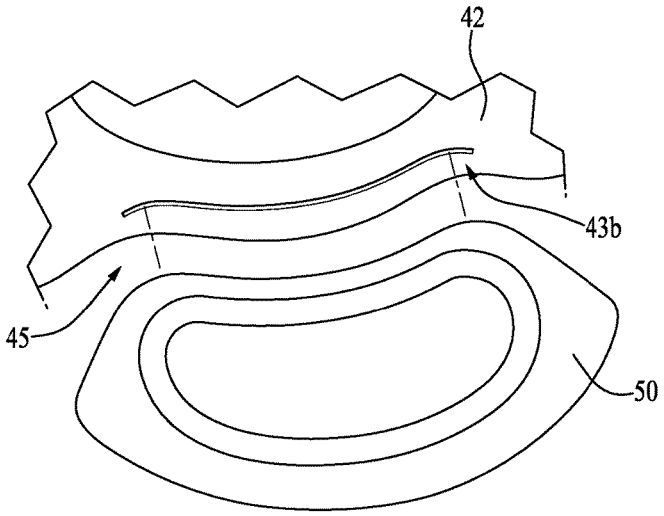
FIG. 4 is a detailed view of a portion of the compact jumper of FIG. 1, showing the toy panel of FIG. 3 detached from the seat platform.

The toy panels 50 may be removably attached to the seat platform 42 by a variety of fastening methods. For example, the seat platform 42 may include one or more female receiving members **43*b* and the toy panels 50 may include one or more corresponding male insertion members 43*a* configured to removably engage the female receiving members 43*b* (see FIGS. 3-4). In one example embodiment, the toy panels 50 include a living hinge or snap-like resilient tongue 44 to removably engage the seat platform 42, which can easily be manipulated by flexing to disengage the platform 50** therefrom. Alternatively, the attachment means may be snaps, hook and loop fasteners, straps, dovetail locks, clips, buckles, or any other traditional fastening means.

Previously known removable toy panels typically rest on top of a portion of an underlying support or mounting platform. Thus, the material of these two components (the toy 50 and the support platform) significantly overlap, which can be referred to as a "double wall" and which can needlessly waste material resources. The toy panels 50 according to example embodiments of the present invention are configured to "complete" the shape of the seat platform 42 when attached to the seat platform 42. For example, the seat platform 42 may comprise an irregular shape including one or more recessed portions 45 within which the removable toy panels 50 are configured to fit in a complementary fashion (see FIG. 4). When the toy panels 50 are attached to the seat platform 42, the recessed portions are filled in, and the seat platform 42 forms a generally triangular or otherwise regular shape. Using the toy panels 50 to complete the shape of the seat platform 42, as opposed to toy panels that overlap or sit on top of the seat platform, eliminates the "double wall" and significantly reduces the amount of material needed in manufacturing the jumper 10, potentially resulting in greater efficiency and cost reductions. Optionally, the seat platform 42 can comprise one or more additional fittings or couplings for receiving additional entertaining toy devices 80.

The at least one resilient member 60 preferably comprises a spring, for example, a coil spring, or alternatively can comprise one or more elastic bands, bungee cords or other extensible members. In example forms, the coil spring is sized and shaped to fit around the upright frame member 24 to suspend the child-receiving apparatus 40 from the frame 20 and guide the motion of the apparatus. Each upright frame member 24 preferably has a corresponding resilient member 60 associated therewith whereby a first end of the member 60 is attached to the seat platform 42 (generally around the opening permitting the upright frame member 24 to extend therethrough) and a second end of the member 60 is attached to the free or top end of the upright frame member 24. Thus, with the spring fitted on the upright frame member 24, the seat platform 42 is suspended from and movably mounted to the frame 20, and its motion is constrained by or guided along the upright frame member 24 to move along a generally vertical motion path, and to limit lateral or transverse horizontal motion of the seat platform which could decrease stability and increase the risk of tipping. Preferably, the lower portions of upright frame members 24 comprise an outward bend, curve or other shape that is generally transversely offset from the axis of the upper portion of the upright frame members, which acts as a secondary safety feature for preventing the seat platform 42 from ever reaching the support surface and injuring a child. For example, the triangular array of openings that receive the upright members 24 are dimensioned to receive only the upper portions thereof, and the lower portions of the upright members 24 are generally axially offset or otherwise dimensioned to prevent the support platform 42 from falling to the support surface, for example, in a situation where the springs 60 were to fail and not support the platform 42. Thus, the bend in each of the upright frame members 24 provide a secondary safety feature, which is an advantageous and cost-saving alternative to common known secondary safety strap assemblies of known jumpers.

Figure 7:
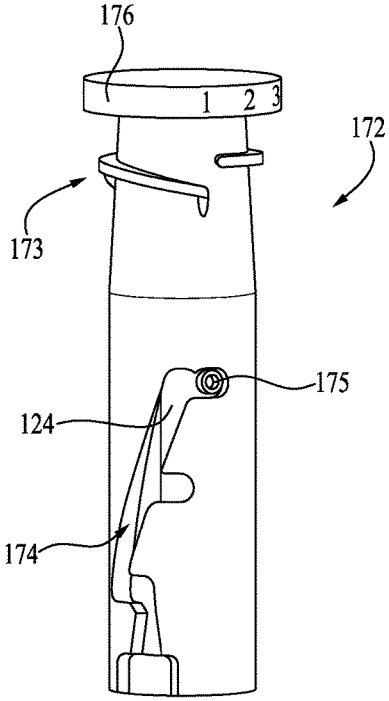
FIG. 7 is a perspective view of a height adjustment rod of the compact jumper of FIG. 5.
Figure 8:
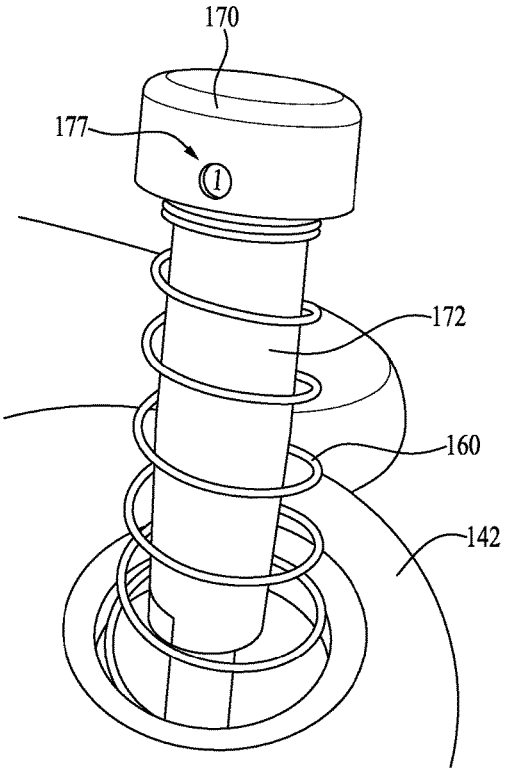
FIG. 8 is a detailed view of the height adjustment rod of FIG. 7 assembled with the support post and spring portion of FIG. 6.

Optionally, an adjustment knob 70 is rotationally connected at the top of the upright frame member 24, and coupled to the second end of the spring such that rotation of the knob 70 causes adjustment of the height of the child-receiving apparatus 40. Each upright frame member 24 may comprise an adjustment knob 70 to adjust the overall height of the child-receiving apparatus 40 relative to the support surface, or alternatively a single adjustment actuator can be linked to one or more support members for coupled height adjustment. In one form, the adjustment knob 70 is configured to provide a height adjustment of about 3" inches in intervals of about 1" inch. Optionally, as depicted in FIGS. 7-8 (as will be described below), a height adjustment rod can be provided within the upright fame members 24 such that rotation of the adjustment knob 70 displays a number corresponding to the height setting, which can be beneficial to assuring the seat platform 42 is level at a particular height setting.

Preferably, the lateral distance M between the outer rim of the child-receiving sling of the seat 46 and the upright frame members 24 is generally configured to be large enough to prevent the child occupying the sling 47 from grabbing one or more of the upright frame members 24 (or knob 70) and pulling or getting out of the sling 47 on their own. In one example form, the minimum distance M between the upright frame members 24 and the outer perimeter of the sling 47 is about 5" inches, and more preferably about 7" inches.

In example embodiments, the compact jumper 10 comprises a substantially minimal volumetric or spatial containment envelope (length (L)×width (W)×height (H)) when compared to the volumetric envelopes of known jumpers, which is accommodating for transporting or relocating the jumper 10 to another location, or to store the jumper 10 away in a closet when not in use or in vehicle while traveling. In one example form, the jumper 10 comprises a volumetric envelope of no more than about 11.08 $ft^3$ (2.45 ft (L)×2.55 ft (W)×1.77 ft (H)) or 0.31 $m^3$ (0.746 m×0.778 m×0.54 m) (see phantom cube of FIG. 1). In alternate embodiments the volumetric envelope is no more than about 13.85 $ft^3$ (0.39 $m^3$), in another embodiment no more than about 12.19 $ft^3$ (0.34 $m^3$), in yet another embodiment no more than about 9.97 $ft^3$ (0.28 $m^3$) or in another embodiment no more than about 8.31 $ft^3$ (0.24 $m^3$). Furthermore, the volumetric envelope of the jumper can alternatively be calculated by the diameter D of a circle surrounding or circumscribing outer contour of the assembled triangular-shaped base frame members 22 along with the height of jumper 10. Thus, in another form, the jumper comprises a volumetric envelope ($\pi$(pi)×radius$^2$ ((D/2)$^2$)×height (H)) of no more than about 39.07 $ft^3$ (3.14×(2.65 ft)$^2$×1.77 ft) or 1.11 $m^3$ (3.14×(0.808 m)$^2$×0.54 m) (see phantom cylinder of FIG. 3). In alternate embodiments, the volumetric envelope is no more than 48.83 $ft^3$ (1.38 $m^3$), in another embodiment no more than about 42.97 $ft^3$ (1.22 $m^3$), in yet another embodiment no more than about 35.16 $ft^3$ (1.00 $m^3$) or in another embodiment no more than about 29.30 $ft^3$ (0.83 $m^3$). Optionally, the volumetric envelop can be calculated using other shapes, for example, a triangular prism or other geometrical envelope generally surrounding the compact jumper. Preferably, the volumetric envelope is calculated in such a manner that any entertaining toy device 80 extending outside the envelope is not considered an outer dimension of the compact jumper for calculation purposes, but generally only the frame and seat supporting platform, optionally including any additional permanently affixed structural components. Preferably, as described above, since the child-receiving apparatus 40 is constrained to moving along a substantially vertical motion path due to being guided by the upper frame members 24, the lateral motion of the child-receiving apparatus 40 is substantially minimal and thus allows for a reduction to the area (length×width) of the support frame 20. Thus, the area of the support frame 20 can be significantly small due to minimal allowable lateral movement of the child-receiving apparatus 40, thereby providing a substantially compact jumper 10.

Figures 5, 6:
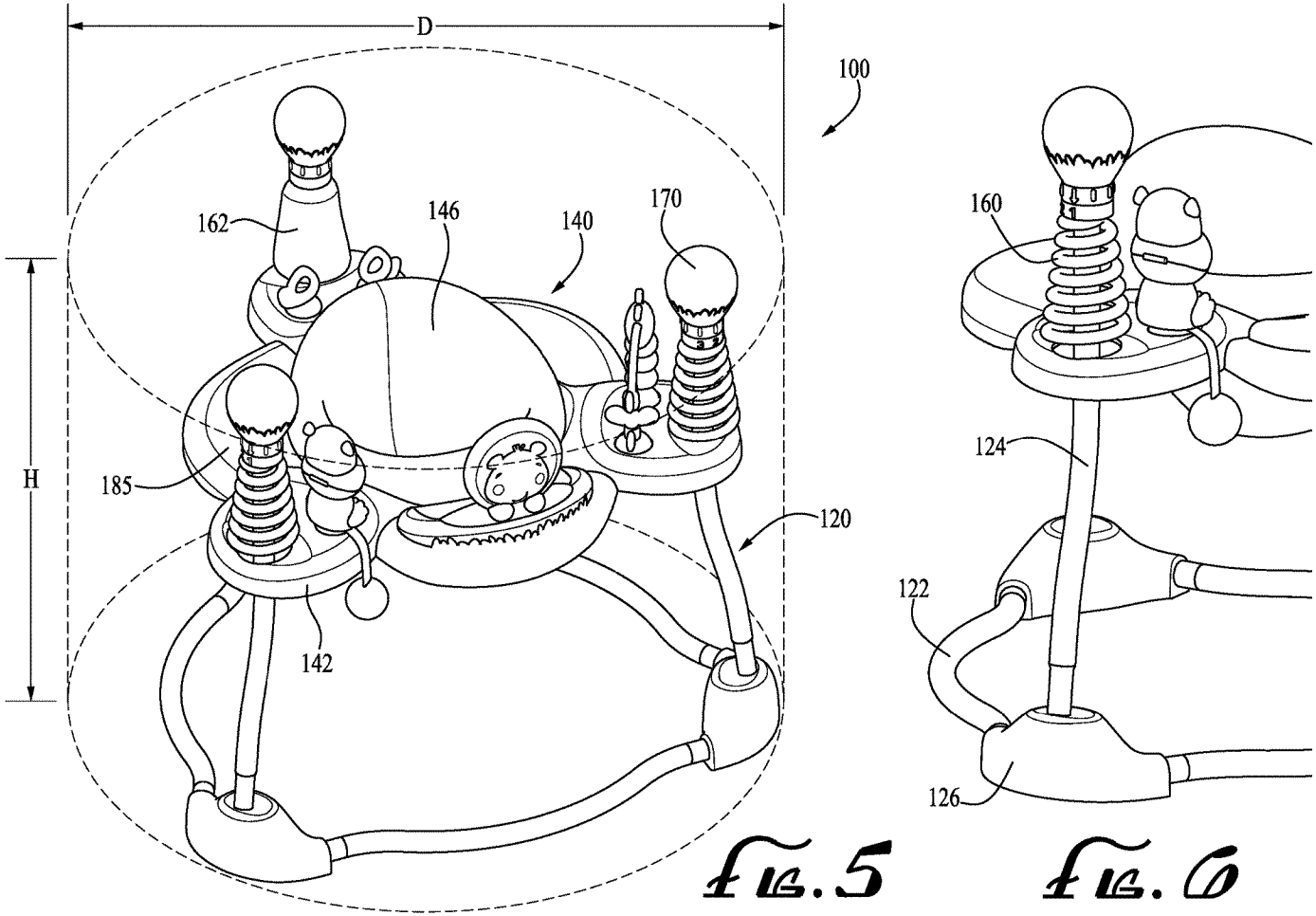
FIG. 5 is a perspective view of a compact jumper according to another example embodiment of the present invention.
FIG. 6 is a detailed view of a support post and spring portion of the compact jumper of FIG. 5.

FIGS. 5-6 depict a compact jumper 100 according to another example embodiment of the present invention. In this embodiment, conical-shaped coil springs 160 support the child-receiving apparatus 140 from the upright frame members or posts 124. The conical coil springs 160 have a smaller diameter at their upper ends where coupled to the upper ends of the posts 124, and a larger diameter at their lower ends where coupled to the child-receiving apparatus 140. In this manner, the post-receiving openings in the seat platform 142 are substantially larger than the diameter of the posts 124, thereby reducing friction and potential binding between the parts during motion and eliminating a potential pinch point. Additionally, the conical coil springs provide self-centering of the opening of the seat platform 42 with respect to the upper frame members 24. A fabric sheet or cover 162 can be applied around one or more of the springs 160 to prevent a child from accessing the pinching their fingers between the coils (see FIG. 5). An integral or removable tray 185 may be provided on the seat platform 142 for supporting small toys, food, or the like.

Furthermore, as shown in FIGS. 7-8 and as briefly described above, a height adjustment rod or sleeve 172 can be provided with an adjustment knob 170 to provide for adjusting the height of the child-receiving apparatus 140 relative to the support surface. As depicted, the height adjustment rod 172 generally comprises a tube-like cylinder sized and shaped to receive the upper end of the upright frame member 124 and rotationally mount thereto. A top portion of the rod 172 defines a rib-like feature 173 extending along an outer periphery thereof for engaging the upper end of the coil spring 160 and a medial or lower portion of the rod 172 comprises a channel 174 having one or more height setting slots in communication therewith. Preferably, a pin, bolt or other member 175 extends from the upright frame member 124 and is movable within the channel 174 and height setting slots. When the pin 175 is engaged with one of the height setting slots, the rod 172 is prevented from moving up and down, but when the pin 175 is disengaged from the height setting slot, the rod 172 can move up and down as desired to adjust the height of the child-receiving apparatus 140 whereby the pin 175 engages a desired height setting slot. Furthermore, a numbered height setting dial 176 preferably sits atop the height adjustment rod 172 such that the particular height setting number (e.g., 1, 2, 4, etc.) is shown within an opening 177 provided on the adjustment knob 170. In one form, the dial 176 is rotationally fixed relative to the upright frame member 124 but is free to move up and down with the adjustment knob 170 and rod 172, thereby accurately indicating the correct height setting within the opening 177 as the knob 170 is turned. Preferably, the spring 160 is preloaded when mounted to the seat platform 142 and the rib-like feature 173 of the rod 172 such that the spring biases the height setting slot to remain engaged with the pin 175 of the upright frame member 124 until a torque is applied to the adjustment knob 170. Thus, by preloading the spring 160, the rod 172 will remain engaged at a particular height setting until a rotational force is applied to the adjustment knob 170 to overcome the bias of the preloaded spring 160, thus allowing adjustment to the height of the child-receiving apparatus 140 relative to the support surface.

Figure 9A:
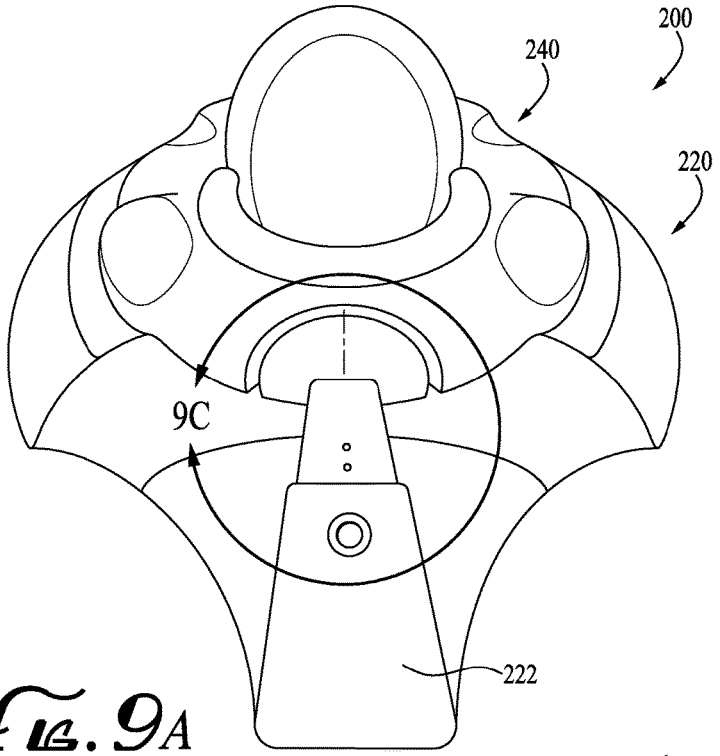
FIGS. 9A-9E show a compact jumper according to another example embodiment of the present invention.
Figure 9B:
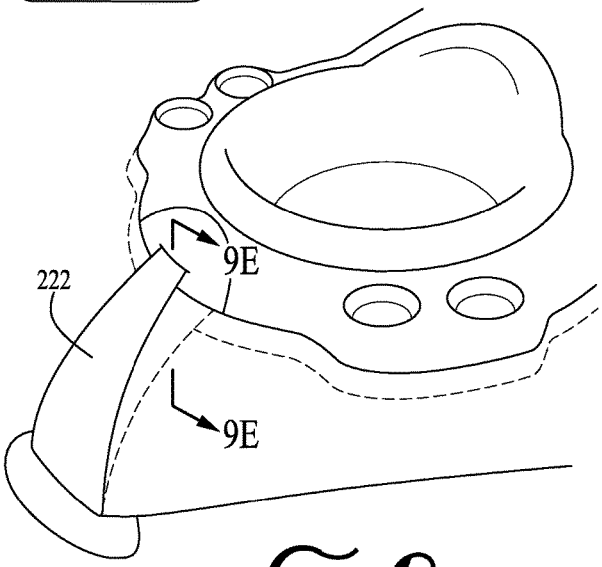
Figure 9C:
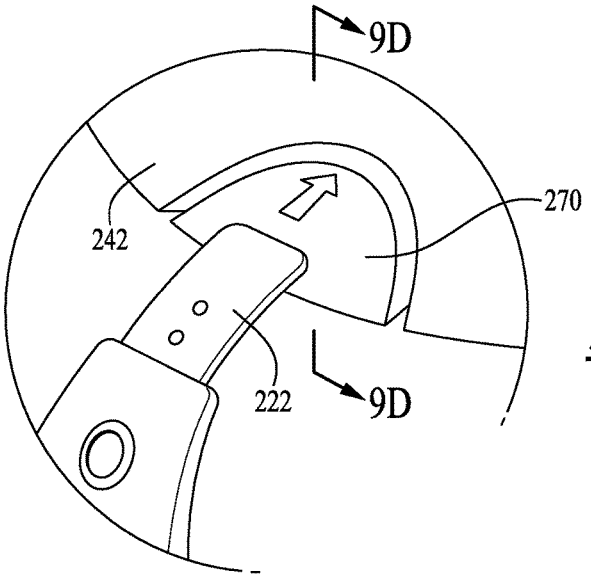
Figure 9D:
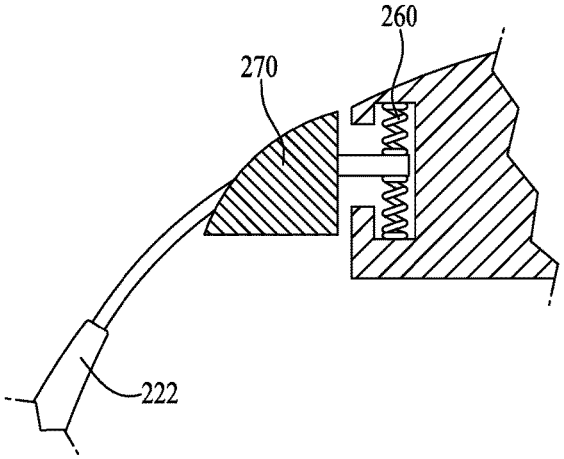
Figure 9E:
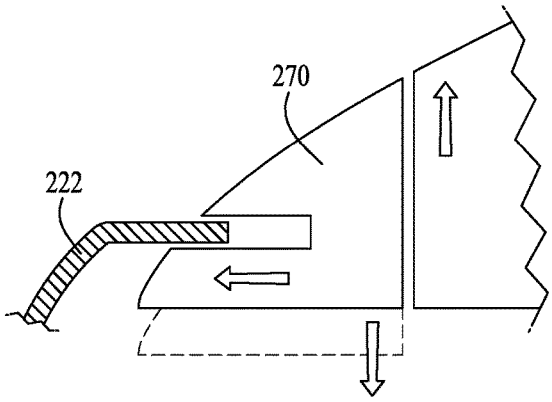

FIGS. 9A-E show a compact jumper 200 according to another example embodiment of the present invention. As depicted, the compact jumper 200 generally comprises a support frame 220, a child-receiving apparatus 240, and at least one spring or other resilient member 260 supporting or suspending the child receiving apparatus from the support frame. Generally, the support frame 220 comprises three arcuate frame members 222 that extend from a base or support surface to a connecting portion of the child-receiving apparatus 240, thus supporting the child-receiving apparatus 240. The upper end of each frame member 222 is mounted to a movable carriage or wedge 270 that is mounted to an outer periphery of the child-receiving apparatus 240. In example forms, the frame members 222 can be shortened or lengthened by incremental insertion or removal from the wedge 270 (see FIG. 9E). Optionally, as shown in FIG. 9C, the frame member 222 can comprise a lower frame member and an upper frame member that are capable of relative movement therebetween to provide for adjustment to the height of the child-receiving apparatus relative to the support platform. At least one resilient member 260 couples the movable wedge 270 to the seat platform 242. In the depicted embodiment, the resilient member comprises first and second opposed springs acting alternatively in tension and compression as the child moves in the device. As such, the child-receiving apparatus 240 is indirectly supported by the at least one resilient member 260 to allow the child-receiving apparatus 240 to move along a substantially vertical motion path.

Figure 11:
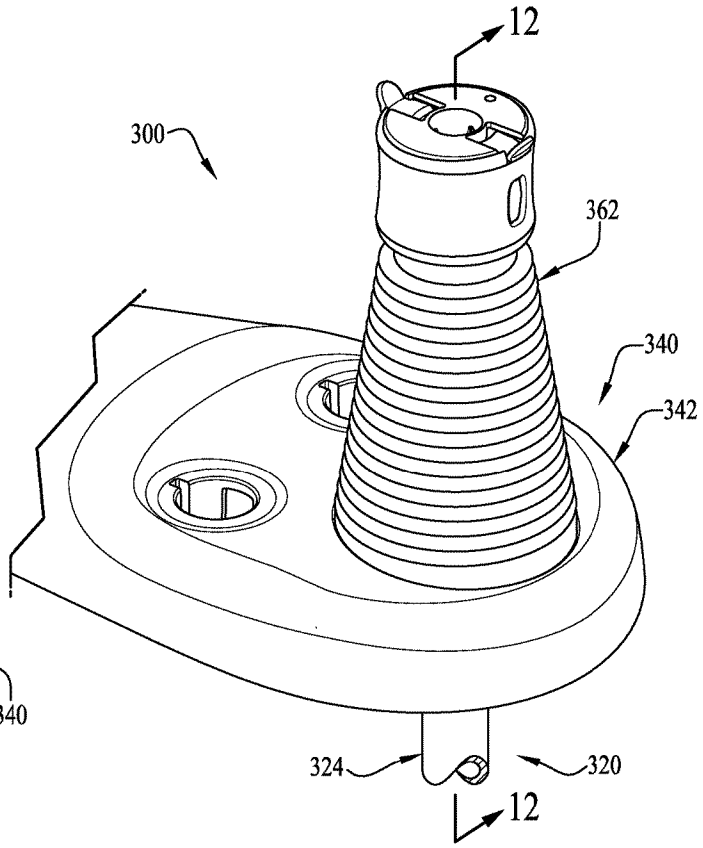
FIG. 11 shows the compact jumper portion of FIG. 10 with the cover removed to reveal the resilient.
Figure 10:
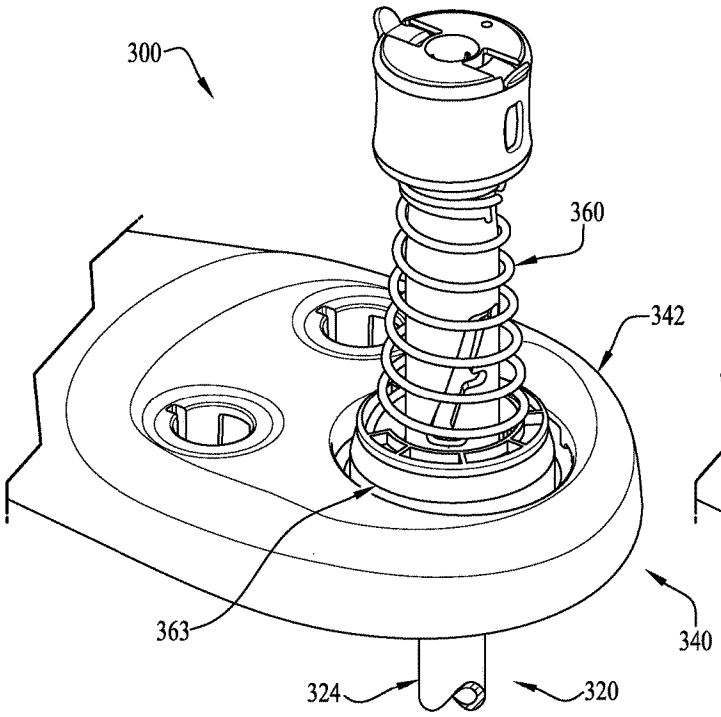
FIG. 10 is a perspective view of a portion of a compact jumper according to another example embodiment of the present invention, showing a covered resilient member supporting or suspending a child-receiving apparatus from a support frame.
Figure 12:
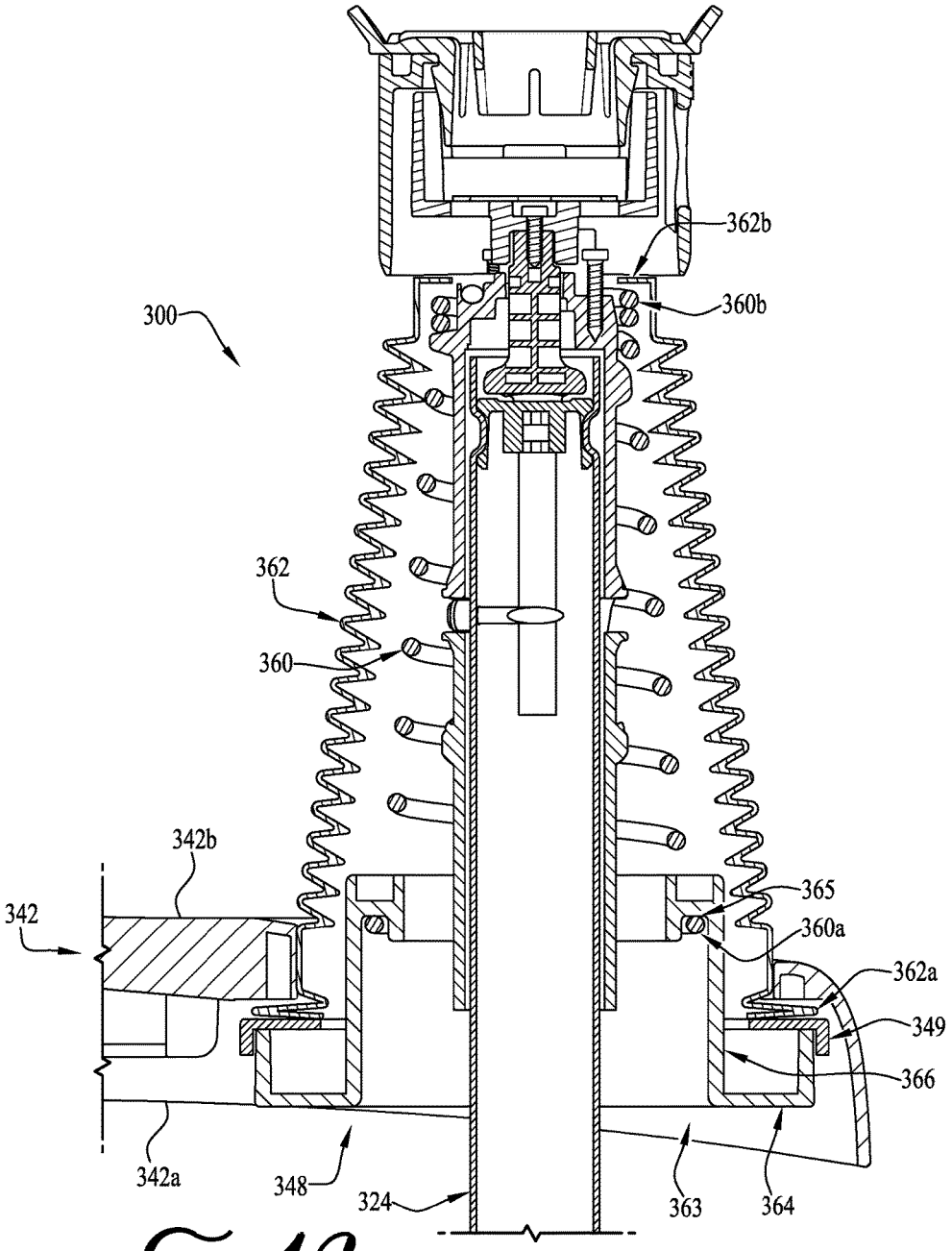
FIG. 12 is a side cross-sectional view of the compact jumper portion of FIG. 10, showing an example mounting of the resilient member between the child-receiving apparatus and the support frame.

FIGS. 10-12 show a compact jumper 300 according to another example embodiment of the present invention. As depicted, the compact jumper 300 generally comprises a support frame 320, a child-receiving apparatus 340, and at least one resilient member 360 supporting or suspending the child receiving apparatus from the support frame. In that regard, the compact jumper 300 is similar to the other embodiments described herein.

As such, the compact jumper 300 typically includes a height-adjustment mechanism having a series of mechanical stops (e.g., defined by lateral slots communicating with a connecting channel, as depicted), a projecting member (e.g., the depicted pin) that slides along the channel to engage the stop surfaces, and an actuator (e.g., the depicted rotary knob) for adjusting the position of the projecting member relative to the mechanical stops. The mechanical stops can be formed on the upright frame members 324 of the support frame 320 and the projecting member can be formed on a sleeve (depicted), bar, etc. extending from the seat platform 342 of the child-receiving apparatus 340 and positioned adjacent the upright frame members, or vice versa. Alternatively, the compact jumper can include another mechanism for adjusting the height of the child-receiving apparatus 340 relative to the support surface.

In addition, the one or more resilient members 360 are typically provided by coil springs (e.g., conical-shaped, as depicted) that support the seat platform 342 of the child-receiving apparatus 340 from the upright frame members 324 of the support frame 320. And the coil springs 360 are typically covered by respective flexible spring covers 362 (e.g., conical-shaped sleeves, shrouds, or bellow-like surrounding layers) to prevent a child from inserting and pinching their fingers between the coils. As depicted, the upright frame members 324, the coil springs 360, and the spring covers 362 can be coaxially arranged with each other. The bottom 362*a* of each spring cover 362 typically extends below the bottom end 360*a* of the respective coil spring and mounts to the seat platform 342. And the top 362*b* of each spring cover typically extends above the top end 360*b* of the respective coil spring and mounts to the respective upright frame member 324. The bottom 362*a* of the spring cover 362 is typically attached to the seat platform 342 at a position below its top surface 342*b*, for example within the opening 348 through which the respective upright frame member 324 extends.

In this embodiment, the seat platform 342 includes at least one collar 363 positioned within each respective frame-member opening 348 of the seat platform, for example in a coaxial arrangement as depicted. The collars 363 can have an annular shape (as depicted) or they can have a curved shape not forming a complete 360-degree closed annulus (e.g., arc-shaped). The collars 363 are attached to the seat platform 342, for example by fasteners or a snap-fit coupling, or by being formed as integral portions of the seat platform.

Each collar 363 attaches a respective coil spring 360 to the seat platform 342; as such the coil springs are still attached to the seat platform but just indirectly so via the collars of the seat platform. As depicted, for example, the collars 363 can be attached at a bottom surface 342*a* of the seat platform 342. And the collars 363 can each include an outward-extending flange 364 that is positioned below and engaged by an inward-extending flange 349 of the seat platform 342 (in a respective frame-member opening 348) so that when the seat platform is pushed downward during use the collar is pushed down by/with it and when the collar is pulled up by the coil spring 360 the seat platform is pulled up by/with it. Also, each collar 363 has a spring mount 365 that attaches to the bottom end 360*a* of its respective coil spring 360. The spring mounts 365 can be provided by recesses (e.g., peripheral grooves), clamps, or other structures for engaging the spring to provide the functionality described herein.

Furthermore, each collar 363 can have an upright extension portion 366 (e.g., a tube-segment wall) extending between its lower seat-platform attachment and its upper spring mount 365. The collar extension portion 366 can have a length (height) selected so that the spring mount 365, and thus the spring bottom end 360*b*, is positioned above the seat-platform top surface 342*b*. As such, the spring bottom ends 360*b* do not extend down into the respective frame-member openings 348, thereby providing for a more buffered spring-mounting arrangement.

While the invention has been described with reference to preferred and example embodiments, it will be understood by those skilled in the art that a variety of modifications, additions and deletions are within the scope of the invention, as defined by the following claims.

What is claimed is:

1. An infant jumper comprising:

a seat assembly comprising a seat platform with a seat mounted thereto;

a support frame comprising at least one upright support post extending through the frame opening of the seat platform; and at least one resilient member extending between the support post and the seat platform to suspend the seat assembly from the support frame and allow movement of the seat relative to the support frame;

wherein the infant jumper comprises a volumetric envelope having an area defined by the equation: ($A=L\times W\times H$), wherein "A" is the area of the volumetric envelope, "L" is the length of the infant jumper, "W" is the width of the infant jumper, and "H" is the height of the infant jumper;

wherein the area of the volumetric envelope is between about 8.31 $ft^3$ and about 13.85 $ft^3$.

2. The infant jumper of claim 1, wherein the movement of the seat relative to the support frame is substantially vertical.

3. The infant jumper of claim 1, wherein the support frame comprises at least one base frame member from which the at least one upright support post extends.

4. The infant jumper of claim 3, wherein the support frame comprises three base frame members and three upright support posts, the three base frame members coupled together with connectors and the upright support posts coupled to the connectors and extending in a direction generally transverse the base frame members.

5. The infant jumper of claim 1, wherein the seat is rotationally mounted to the seat platform.

6. The infant jumper of claim 1, wherein the resilient member is a spring.

7. The infant jumper of claim 6, wherein the spring is a coil spring comprising a generally conical shape.

8. The infant jumper of claim 7, wherein the conical coil spring has a lesser dimension at a first end coupled to the frame and a greater dimension at a second end coupled to the seat assembly.

9. The infant jumper of claim 8, wherein the frame opening of the seat platform has a dimension substantially greater than a corresponding dimension of the support post extending therethrough.

10. The infant jumper of claim 8, further comprising a cover over the spring.

11. The infant jumper of claim 8, wherein the spring is a coil spring having a generally conical shape, and wherein the spring cover has a generally conical shape for covering the coil spring.

12. A compact jumper comprising:

a support frame comprising a base and at least one support post;

a seat assembly comprising a seat platform with a seat mounted thereto, the seat platform defining at least one frame opening through which a corresponding support post extends; and at least one resilient member extending between each support post and the seat assembly, wherein motion of the seat assembly is constrained vertically by the at least one resilient member and is constrained laterally by the at least one support post extending through the corresponding frame opening of the seat platform;

wherein the compact jumper comprises a spatial containment envelope having an area defined by the equation: ($A=\pi\times(D/2)^2\times H$) wherein "A" is the area of the spatial containment envelope, "D" is the diameter of the base of the support frame, and "H" is the height of the compact jumper;

wherein the spatial containment envelope has an area of between about 29.30 $ft^3$ and 48.83 $ft^3$.

13. The compact jumper of claim 12, wherein the base of the support frame comprises a diameter that is less than or equal to about 5.3 feet and wherein the compact jumper comprises a height that is less than or equal to about 1.77 feet.

14. The compact jumper of claim 12, wherein the area of the spatial containment envelope is less than or equal to about 39.07 $ft^3$.

15. The compact jumper of claim 12, wherein the resilient members comprise coil springs.

16. The compact jumper of claim 12, wherein the coil springs are generally conical, having a lesser dimension at a first end coupled to the frame and a greater dimension at a second end coupled to the seat assembly.

17. The compact jumper of claim 16, further comprising a spring cover having a generally conical shape for covering the conically-shaped coil spring.

18. The infant jumper of claim 1, wherein the infant jumper comprises:

a length L less than or equal to about 2.45 feet;

a width W less than or equal to about 2.55 feet; and a height H less than or equal to about 1.77 feet.

19. The infant jumper of claim 1, wherein the area of the volumetric envelope is less than or equal to about 11.08 $ft^3$.

* * * * *